US010415522B2

(12) United States Patent
Minixhofer et al.

(10) Patent No.: US 10,415,522 B2
(45) Date of Patent: Sep. 17, 2019

(54) FUEL INJECTOR

(71) Applicant: Robert Bosch GmbH, Stuttgart (DE)

(72) Inventors: Claus Minixhofer, Feldkirchen (AT); Friedrich Kroepl, Kronstorf (AT); Georg Sengseis, Linz (AT); Peter Luckeneder, Walding (AT); Roland Mitter, Gramastetten (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/778,233

(22) PCT Filed: Oct. 5, 2016

(86) PCT No.: PCT/EP2016/073732
§ 371 (c)(1),
(2) Date: May 23, 2018

(87) PCT Pub. No.: WO2017/089017
PCT Pub. Date: Jun. 1, 2017

(65) Prior Publication Data

US 2018/0340500 A1 Nov. 29, 2018

(30) Foreign Application Priority Data

Nov. 23, 2015 (DE) ..... 10 2015 223 043

(51) Int. Cl.
*F02M 47/02* (2006.01)
*F02M 63/00* (2006.01)

(52) U.S. Cl.
CPC ..... *F02M 47/027* (2013.01); *F02M 47/02* (2013.01); *F02M 63/0015* (2013.01);
(Continued)

(58) Field of Classification Search
CPC ..... F02M 63/0031; F02M 47/02; F02M 63/0015; F02M 63/0075; F02M 47/027; F02M 2200/50; F02M 2200/07
See application file for complete search history.

(56) References Cited

U.S. PATENT DOCUMENTS

2002/0158219 A1* 10/2002 Boecking ..... F02B 47/02 251/129.06
2003/0132410 A1* 7/2003 Stoecklein ..... F02M 47/025 251/57

(Continued)

FOREIGN PATENT DOCUMENTS

DE 102008040015 12/2009
DE 102009001704 9/2010

(Continued)

OTHER PUBLICATIONS

International Search Report for Application No. PCT/EP2016/073732 dated Nov. 11, 2016 (English Translation, 3 pages).

*Primary Examiner* — Sizo B Vilakazi
(74) *Attorney, Agent, or Firm* — Michael Best & Friedrich LLP

(57) ABSTRACT

The invention relates to a fuel injector, in particular a common-rail injector (1), comprising an injector housing (2), in which a nozzle needle (8), which is arranged in such a way that the nozzle needle can be moved in a reciprocating manner, is arranged in a high-pressure chamber (6) in order to open and close at least one injection opening (5), which nozzle needle bounds a control chamber (20) by means of one end face and interacts with a nozzle body seat (10) by means of the other end face in order to open and close the injection opening (5). The nozzle needle (8) has a first sleeve-shaped supporting element (14), to which force is applied in the closing direction of the nozzle needle (8). In addition, the nozzle needle (8) has a second sleeve-shaped (Continued)

supporting element, which surrounds the nozzle needle (8) and which is arranged in the direction of the end face of the nozzle needle (8) that is close to the control chamber. The second supporting element (16) is arranged at a distance from the first supporting element (14) axially in the closing direction of the nozzle needle (8). At least one of the stop surfaces (33, 34) of the first (14) sleeve-shaped supporting element or of the second (16) sleeve-shaped supporting element that face each other has at least one cut-out (36).

17 Claims, 5 Drawing Sheets

(52) U.S. Cl.
CPC .... *F02M 63/0031* (2013.01); *F02M 63/0075* (2013.01); *F02M 2200/07* (2013.01); *F02M 2200/50* (2013.01)

(56) References Cited

U.S. PATENT DOCUMENTS

| | | | | |
|---|---|---|---|---|
| 2005/0089426 | A1* | 4/2005 | Kurz | F02M 45/086 417/494 |
| 2010/0294243 | A1* | 11/2010 | Ganser | F02M 47/027 123/476 |
| 2012/0160214 | A1* | 6/2012 | Salcedo | F02M 51/0603 123/446 |

FOREIGN PATENT DOCUMENTS

| | | |
|---|---|---|
| DE | 102014209997 | 11/2015 |
| EP | 1970558 | 9/2008 |

* cited by examiner

FUEL INJECTOR

BACKGROUND OF THE INVENTION

The invention relates to a fuel injector, in particular a common rail injector, for injecting fuel into a combustion chamber of an internal combustion engine.

A fuel injector of this kind, in particular a common rail injector, is known from DE 10 2009 001 704 A1 and from DE 10 2014 209 997, which is not a prior publication. A high-pressure space is formed within a nozzle body of the injector housing. Arranged in the injector body there is furthermore a valve piece, which accommodates a nozzle needle end facing away from an injection opening. In this case, the nozzle needle is subjected to a force in the closing direction by means of a return spring, wherein the nozzle needle interacts with a nozzle body seat and thereby opens and closes at least one injection opening. Moreover, the nozzle needle has a radially encircling offset, on which a first sleeve-shaped supporting element rests, wherein the first sleeve-shaped supporting element is subjected to a force in the closing direction of the nozzle needle by the return spring. In this case, the return spring is supported by means of its other end against a second sleeve-shaped supporting element, which is arranged so as to face the end of the nozzle needle remote from the combustion chamber.

To limit the maximum opening stroke of the nozzle needle, the mutually facing stop surfaces of the first sleeve-shaped supporting element and of the second sleeve-shaped supporting element are at a distance from one another, wherein the distance 35 in the closed position of the nozzle needle defines the maximum opening stroke.

In the open position of the nozzle needle, the stop surface of the first sleeve-shaped supporting element rests against the stop surface of the second sleeve-shaped supporting element. This can lead to hydraulic adhesion of the two stop surfaces. This delays the nozzle closing movement, resulting in imprecise injection.

SUMMARY OF THE INVENTION

It is the underlying object of the invention to develop fuel injectors, in particular common rail injectors, in such a way that more reliable and quicker closing of the nozzle needle and hence more precise metering of the fuel quantity reaching the combustion chamber is made possible.

This object is achieved in the case of the fuel injector according to the invention by virtue of the fact that the fuel injector has an injector housing, in which a nozzle needle, which is arranged in such a way that the nozzle needle can be moved in a reciprocating manner, is arranged in a high-pressure space in order to open and close at least one injection opening, which nozzle needle delimits a control space by means of one end and interacts with a nozzle body seat by means of the other end in order to open and close the injection opening. In this case, the nozzle needle has a first sleeve-shaped supporting element, to which force is applied in the closing direction of the nozzle needle, and the nozzle needle furthermore has a second sleeve-shaped supporting element, which surrounds the nozzle needle and which is arranged in the direction of the end of the nozzle needle that is close to the control chamber, wherein the second supporting element is arranged at a distance from the first supporting element axially in the closing direction of the nozzle needle. In this case, at least one of the mutually facing stop surfaces of the first sleeve-shaped supporting element or of the second sleeve-shaped supporting element has at least one recess. In other words, the mutually facing stop surfaces of two sleeve-shaped supporting elements are provided in such a way with at least one recess that the contact area is reduced. It is thereby possible to reduce possible adhesion forces, and hydraulic adhesion is prevented. In this way, the nozzle needle can be closed without delay and more quickly. Moreover, dripping of the fuel into the combustion chamber is avoided by virtue of the quicker closing operation of the nozzle needle, thereby contributing to compliance with pollution limits for diesel internal combustion engines.

In a first advantageous development of the invention, it is envisaged that at least one recess in the stop surfaces of the first sleeve-shaped element or of the second sleeve-shaped element is designed as a groove. A development of this kind has the advantage that the recess in the stop surfaces of the first sleeve-shaped supporting element or of the second sleeve-shaped supporting element is easy to produce. Here, provision can advantageously be made for the groove cross section to be in the form of a triangle, of a semicircle or of a rectangle, in particular of a square or of a trapezoid. Such different groove shapes have the advantage that, depending on the shape, they allow small contact areas with little material removal of the respective stop surfaces of the first sleeve-shaped supporting element and of the second sleeve-shaped supporting element and thus promote quicker release from one another during the closing operation of the nozzle needle.

Provision can furthermore advantageously made for the grooves to be arranged parallel to one another and/or radially and/or so as to follow the circumference. Furthermore, a curved or intersecting arrangement of the grooves can be provided. Moreover, grooves can be combined into "groove groups", the group elements of which are arranged parallel to one another or enclose an angle with one another. This can be produced in a very simple manner by means of a grinding disk, for example.

In another embodiment of the invention, provision is advantageously made for both the first sleeve-shaped supporting element and the second sleeve-shaped supporting element to be arranged within a nozzle body, which is adjoined by an injector body in the direction of the end of the nozzle needle remote from the combustion chamber. This enables the nozzle body to be constructed in a compact and therefore space-saving manner.

In another advantageous embodiment of the invention, provision is made for the second sleeve-shaped supporting element to be of multi-part design in order not only to achieve simpler assembly but also to implement each of the individual functions of the second sleeve-shaped supporting element in separate construction elements. Thus, provision can be made for a stop ring to be used as a stop surface of the second sleeve-shaped supporting element, against which a second construction element of the second sleeve-shaped supporting element, an adjusting ring, rests, the dimensions of which limit the maximum opening stroke of the nozzle needle. This also allows the use of different materials for the stop ring and the adjusting ring of the second sleeve-shaped supporting element in order to ensure a long service life matched to their functions in the fuel injector. Moreover, the multi-part design of the second sleeve-shaped supporting element ensures a simple and low-cost possibility, in the case of wear on one of the construction elements of the second sleeve-shaped supporting element, of replacing just this worn construction element.

In another embodiment of the invention, provision is advantageously made for there to be a return spring, which exerts a restoring force on the first sleeve-shaped supporting element in the direction of the nozzle body seat to ensure that no fuel can flow into the combustion chamber via the at least one injection opening in the closed position. This exertion of force on the nozzle needle in the closing direction also makes it possible, in the event of possible interruptions in the control of the nozzle needle, to move said needle in the closing direction and to prevent unwanted fuel injection into the combustion chamber of an internal combustion engine. In this case, the return spring is arranged under prestress between the first sleeve-shaped supporting element and the second sleeve-shaped supporting element.

In a design development of the inventive concept, it is envisaged that the maximum opening stroke of the nozzle needle is defined by the distance 35 between the mutually facing stop surfaces of the first sleeve-shaped supporting element and of the second sleeve-shaped supporting element in the closed position of the nozzle needle. These mutually facing stop surfaces of the first sleeve-shaped supporting element and of the second sleeve-shaped supporting element come into contact with one another when the nozzle needle is opened to the maximum extent and thus limit the opening stroke of the nozzle needle.

In another advantageous embodiment of the fuel injector, provision can be made for the nozzle needle to have a radially encircling offset, which serves as a rest for the first sleeve-shaped supporting element.

BRIEF DESCRIPTION OF THE DRAWINGS

Further advantages, features and details of the invention will emerge from the following description of preferred illustrative embodiments and from the drawings, in which.

Elements with the same function are provided with the same reference numerals in the figures.

DETAILED DESCRIPTION

Figure 1:
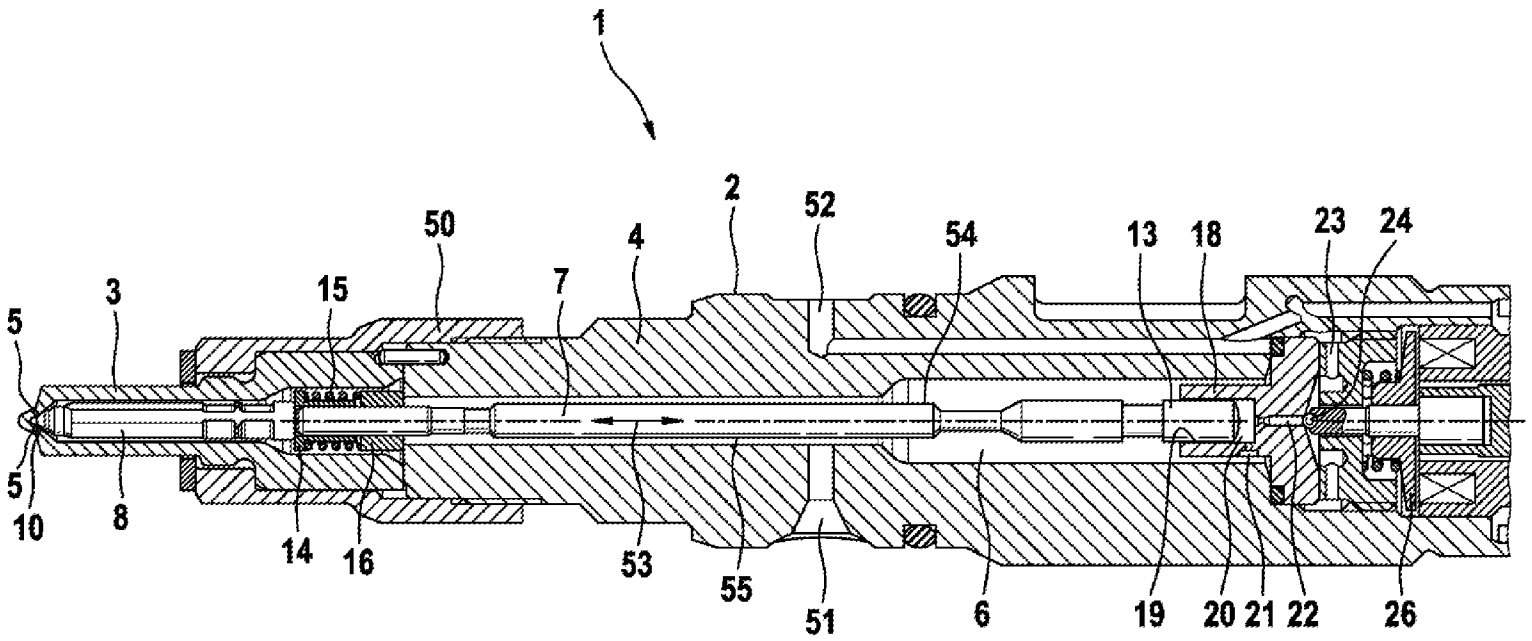
FIG. 1 shows a longitudinal section through a fuel injector according to the invention.

FIG. 1 illustrates a fuel injector 1, in this case a common rail injector, which is used to inject fuel into a combustion chamber (not shown) of an internal combustion engine, in particular an auto-ignition internal combustion engine. The fuel injector 1 has a multi-part injector housing 2, which comprises a nozzle body 3 and an injector body 4 adjoining the nozzle body 3. A pressure-tight connection is formed between the nozzle body 3 and the injector body 4 by means of a nozzle clamping nut 50. Formed within the injector housing 2 is a high-pressure space 6, which is continued into the nozzle body 3, where it is formed by a stepped longitudinal bore. On the side facing the combustion chamber, the nozzle body 3 has at least one injection opening 5, starting from the pressure space, for injecting fuel into the combustion chamber of the internal combustion engine. The high-pressure space 6 can be filled with fuel under system pressure via a feed passage 51. In the illustrative embodiment shown, the feed passage 51 is formed in the central region of the high-pressure space 6, perpendicularly to a longitudinal axis 7 of the fuel injector 1.

A piston-shaped nozzle needle 8 is arranged in the high-pressure space 6 in such a way that it can be moved in a reciprocating manner in its longitudinal direction. FIG. 1 illustrates the closed position of the nozzle needle 8, which closes the at least one injection opening 5 formed in the nozzle body 3. For this purpose, a nozzle body seat 10, with which the nozzle needle 8 interacts, is formed on the inside of the nozzle body 3. To open the injection opening 5, the nozzle needle 8 rises from the nozzle body seat 10 and thus allows a fuel flow from the high-pressure space 6, via the at least one injection opening 5, into the combustion chamber of the internal combustion engine.

Figure 2:
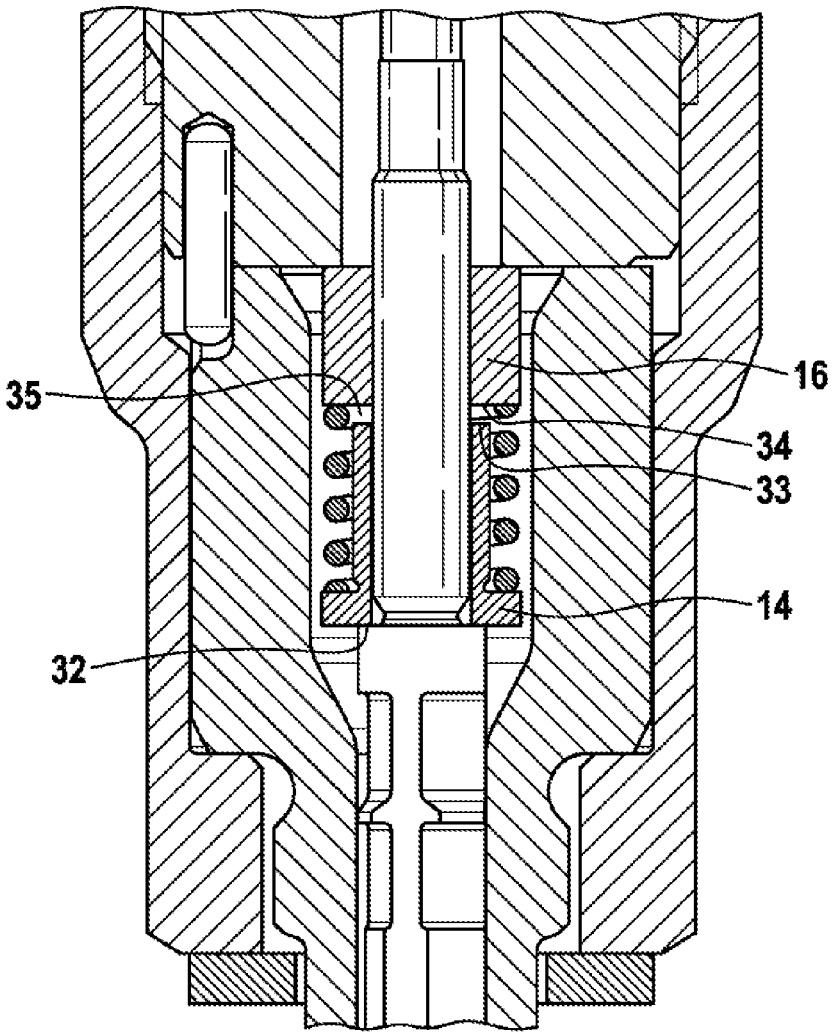
FIG. 2 shows a partial region of the fuel injector shown in FIG. 1 in the region of a device which is characterized by the first sleeve-shaped supporting element and the second sleeve-shaped supporting element and which defines the maximum opening stroke of the nozzle needle.

The nozzle needle 8 is part of a nozzle module 54, which comprises a pin-shaped valve piston 13 on its end remote from the combustion chamber. The nozzle needle 8 and the valve piston 13 are connected to one another by a central piece 55, e.g. by means of laser weld seams. In this case, the nozzle needle 8 is supported in the nozzle body seat 10 in the closed position and can be moved in the longitudinal direction by means of an electromagnet 26, see double arrow 53. In the region of the nozzle needle 8, the nozzle module 54 surrounds a first sleeve-shaped supporting element 14 and a second sleeve-shaped supporting element 16, wherein a return spring 15 is arranged under compressive prestress between the first sleeve-shaped supporting element 14 and the second sleeve-shaped supporting element 16. FIG. 2 shows a partial region of the fuel injector shown in FIG. 1, which shows, on an enlarged scale, the region of the nozzle needle 8 with the first sleeve-shaped supporting element 14, the interposed return spring 15 and the second sleeve-shaped supporting element 16.

On the side of the nozzle module 54 facing away from the combustion chamber, the injector housing 2 comprises a valve piece 18, which has a blind hole 19 on the side facing the valve piston 13. The end region of the valve piston 13 enters this blind hole 19. The valve piston 13 and the blind hole 19 delimit a control space 20, which is connected hydraulically to the high-pressure space 6 by a feed bore 21. An outlet restrictor 22 formed in the valve piece 18 and leading into a low-pressure region 23 of the fuel injector 1 allows hydraulic relief of the control space 20, wherein the outlet restrictor 22 is connected to an outlet passage 52, which is arranged on the opposite side of the injector housing 2 from the feed passage 51.

In order to separate the control space 20 and the low-pressure region 23 hydraulically from one another, the outlet restrictor 22 can be closed by a spherical valve element 24, which is part of a control valve 24. The valve 24 is controlled by means of an electromagnet 26 since the spherical valve element 24 is attached to a magnet armature. Raising of the valve element 24 from the outlet restrictor 22 is initiated by energization of the magnet. The control space 20 and the low-pressure region 23 can thereby be connected hydraulically to one another. This leads to a pressure drop in the control space 20, resulting in a reduction in the hydraulic closing force of the nozzle needle 8. The nozzle needle 8 thus moves by virtue of the force in the high-pressure space 6 acting in the longitudinal direction on the nozzle needle 8. This allows fuel to flow into the combustion chamber of the internal combustion engine via the at least one injection opening 5, which is now open.

As shown in FIG. 2, the first sleeve-shaped supporting element 14 rests on a radially encircling offset 32 of the nozzle needle 8. Together with the first sleeve-shaped supporting element, the second sleeve-shaped supporting element 16, which is arranged on the first sleeve-shaped supporting element 14 via the return spring 15, forms a limit for the maximum opening stroke of the nozzle needle 8. At the maximum opening stroke of the nozzle needle 8, mutually facing stop surfaces 33, 34 of the first sleeve-shaped supporting element 14 and of the second sleeve-shaped supporting element 16 rest against one another. The maximum opening stroke is thereby defined by the axial distance 35 between the mutually facing stop surfaces 33, 34 of the first sleeve-shaped supporting element 14 and of the second sleeve-shaped supporting element 16 in the closed position of the nozzle needle 8. It is a function of the return spring 14 to push the nozzle needle 8 into the nozzle body seat 10 in the direction of the at least one injection opening 5 in order to avoid fuel also flowing into the combustion chamber of the internal combustion engine when the fuel injector is switched off.

Figure 3:
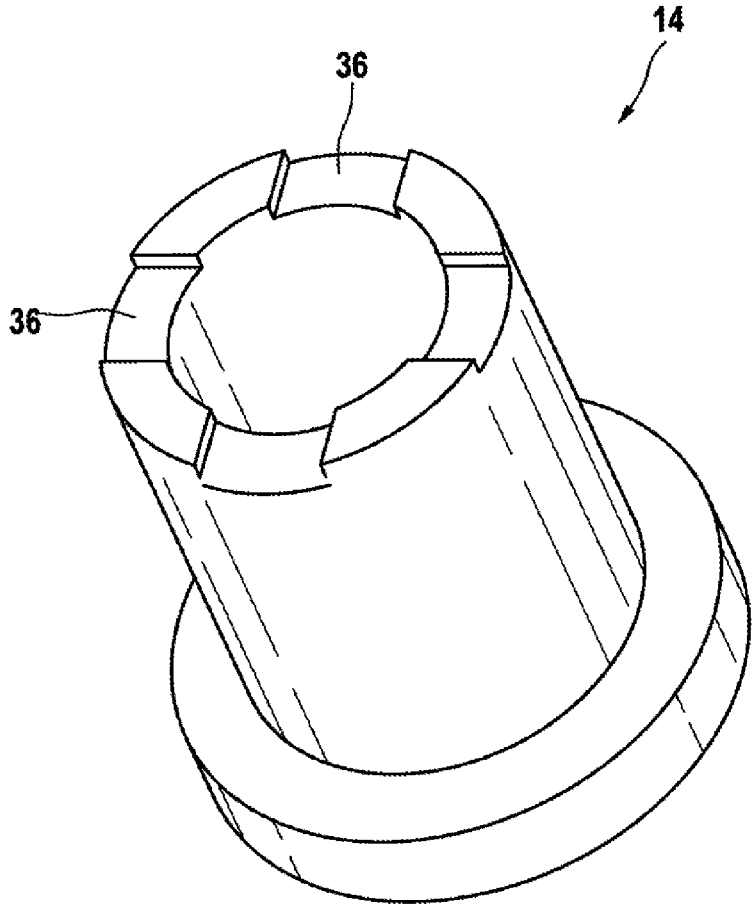
FIG. 3 shows the first sleeve-shaped supporting element in perspective view.
Figure 4:
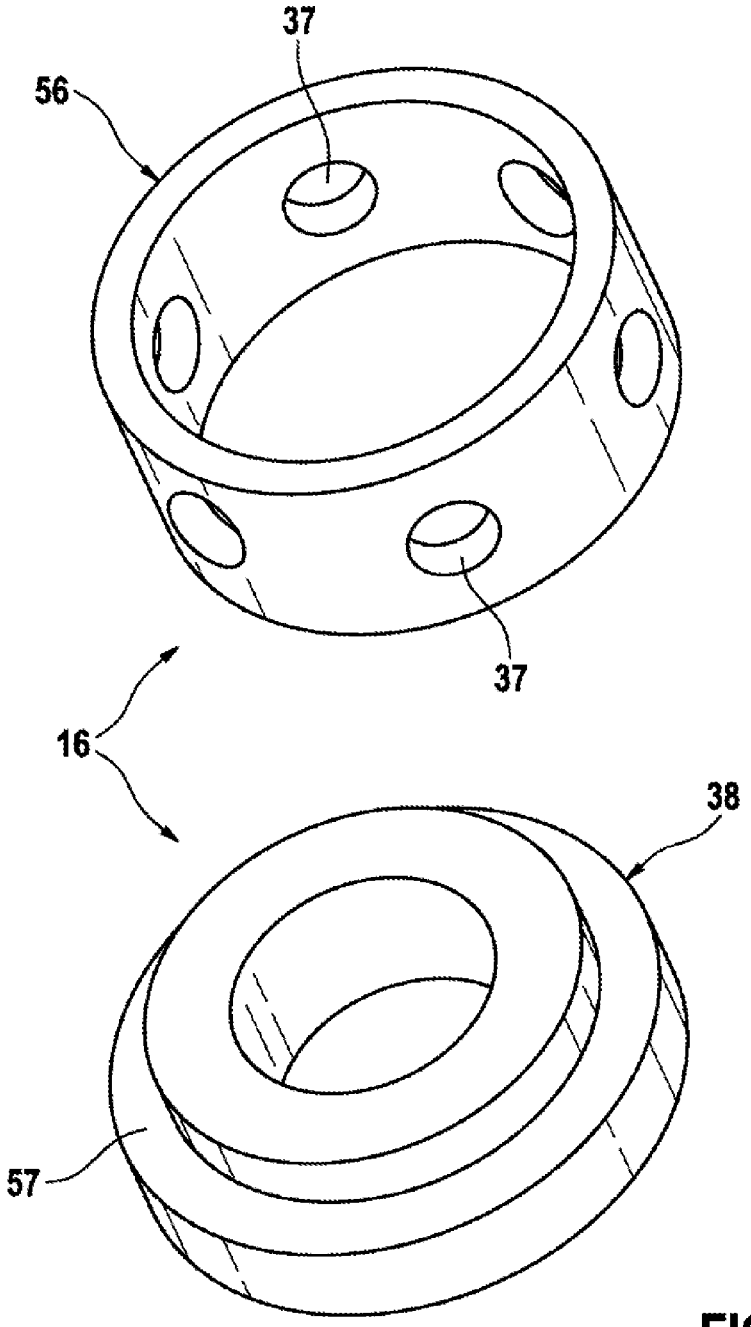
FIG. 4 shows the second sleeve-shaped supporting element in a multi-part embodiment with an adjusting ring and a stop ring in perspective view.

FIG. 3 illustrates a possible illustrative embodiment of the first sleeve-shaped supporting element 14 as a one-piece construction element. In this case, recesses 36 are formed at some points on the stop surface 33 of the first sleeve-shaped supporting element 14, and these are explained in detail in the rest of the description. The second sleeve-shaped supporting element 16 is of multi-part construction. FIG. 4 illustrates a possible illustrative embodiment of the second sleeve-shaped supporting element 16 as a two-part component, which has an adjusting ring 56 with through holes 37 for the fuel and a stop ring 38 arranged on the adjusting ring 56. The adjusting ring 56 forms the component of the second sleeve-shaped supporting element 16 which determines the limit of the maximum opening stroke of the nozzle needle 8 and is passed through completely in the axial direction by the nozzle needle 8 in the installed position in the injector. On the side facing away from the adjusting ring 56, the stop ring 38 has a radially encircling collar 57, wherein the collar 57 serves as a support for the return spring 15. Both the first sleeve-shaped supporting element 14 and the second sleeve-shaped supporting element 16 as well as the return spring 15 are mounted on the nozzle needle 8 before the nozzle needle 8 is welded to the central piece 55. Different diameters of the nozzle needle 8 and the central piece 55 lead to the first sleeve-shaped supporting element 14, the second sleeve-shaped supporting element 16 and the return spring 15 being connected to the nozzle module 54 in a manner which prevents loss.

As already shown in FIG. 3, the stop surfaces 33, 34 of the first sleeve-shaped supporting element 14 and of the second sleeve-shaped supporting element 16 have at least one recess 36, which is formed by a groove shape 39. As a result, the stop surfaces 33, 34 of the first sleeve-shaped supporting element 14 and of the second sleeve-shaped supporting element 16 do not rest upon one another over the full area in the open position of the nozzle needle 8, as a result of which the adhesion forces are reduced. Lower adhesion forces allow quicker release of the stop surfaces 33, 34 of the first sleeve-shaped supporting element 14 and of the second sleeve-shaped supporting element 16 from one another and thus allow more precise closing of the nozzle needle 8 and prevent an unintentional afterflow of fuel into the combustion chamber via the at least one injection opening 5. Moreover, the recesses 36 in the stop surfaces 33, 34 of the first sleeve-shaped supporting element 14 and/or of the second sleeve-shaped supporting element 16 allow the fuel under high pressure to flow into precisely these recesses 36 after the closure of the spherical valve element 24 and thus additionally accelerate the release of the stop surfaces 33, 34 of the first sleeve-shaped supporting element 14 and of the second sleeve-shaped supporting element 16.

Figure 5:
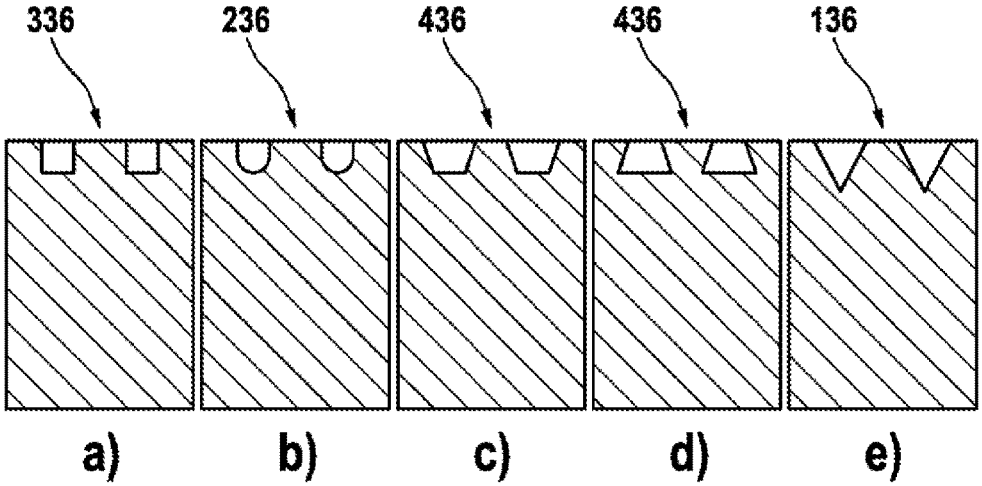
FIG. 5 shows alternative views a through e showing various embodiments of grooves.
Figure 6:
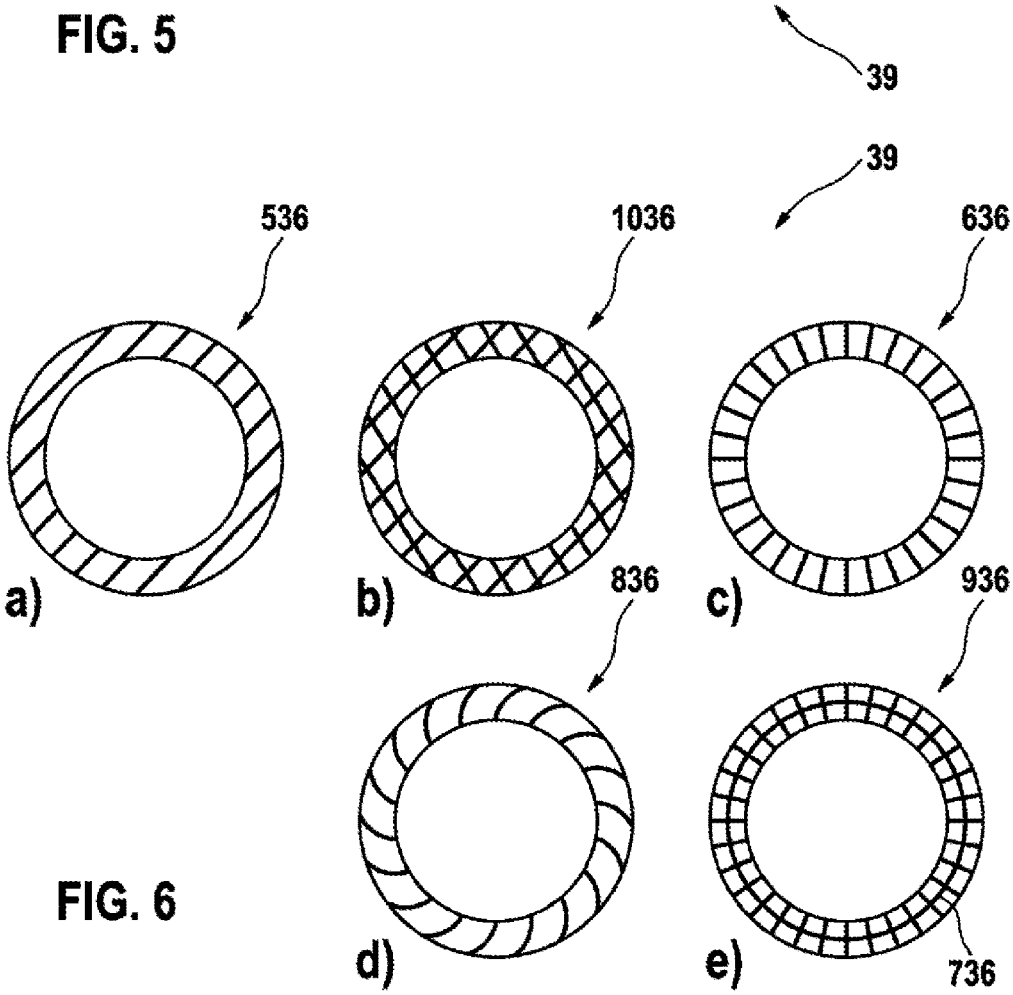
FIG. 6 shows alternative views a through e showing, in a plan view of a stop surface of the first sleeve-shaped supporting element or of the second sleeve-shaped supporting element, grooves which are arranged parallel to one another (view a) and/or radially (view c) and/or so as to follow the circumference of the supporting element (view e).

The recesses 36 have different cross sections. FIG. 5 illustrates possible embodiments of groove cross sections in the form of a triangle 136 (FIG. 5*e*), of a semicircle 236 (FIG. 5*b*) or of a rectangle, in particular of a square 336 (FIG. 5*a*) or of a trapezoid 436 (FIG. 5*c* and FIG. 5*d*). Moreover, FIG. 6 shows, in a plan view of a stop surface 33, 34 of the first sleeve-shaped supporting element 14 or of the second sleeve-shaped supporting element 16, grooves which are arranged parallel to one another 536 (FIG. 6*a*) and/or radially 636 (FIG. 6*c*) and/or so as to follow the circumference of the supporting element 736 (FIG. 6*e*). Moreover, the grooves have a curved profile 836, as shown in FIG. 6*d*, or a mutually intersecting profile 936 (FIG. 6*e*). As illustrated in FIG. 6*b*, there can furthermore be at least two groove groups 1036, wherein elements of a groove group are arranged parallel to one another and elements from different groove groups 1036 enclose an angle with one another.

The groove embodiments presented are used for optimization for quicker release of the stop surfaces 33, 34 of the first sleeve-shaped supporting element 14 and of the second sleeve-shaped supporting element 16 and can also be used in combinations on one stop surface 33 or 34 of the first sleeve-shaped supporting element 14 and of the second sleeve-shaped supporting element 16 in each case.

In addition to all these embodiments, additional groove shapes 39 which perform the same function as the groove shapes 39 already mentioned and, for example, ensure the roughness of the stop surfaces 33, 34 of the first sleeve-shaped supporting element 14 and of the second sleeve-shaped supporting element 16 are also possible.

To reduce the contact area of the stop surfaces 33, 34 of the first sleeve-shaped supporting element 14 and of the second sleeve-shaped supporting element 16, conventional methods such as milling, grinding or stamping can be used. It is also possible to remove material with a laser.

The invention claimed is:

1. A fuel injector, comprising an injector housing (2), in which a nozzle needle (8), which is arranged in such a way that the nozzle needle can be moved in a reciprocating manner, is arranged in a high-pressure space (6) in order to open and close at least one injection opening (5), wherein one end of the nozzle needle delimits a control space (20) and an other end of the nozzle needle interacts with a nozzle body seat (10) to open and close the injection opening (5), wherein the nozzle needle (8) has a first supporting element (14), which is sleeve-shaped and is subjected to a force in a closing direction of the nozzle needle (8), and wherein the nozzle needle (8) has a second supporting element (16), which is sleeve-shaped and surrounds the nozzle needle (8) and which is arranged in a direction of the one end of the nozzle needle (8), wherein the second supporting element (16) is arranged at a distance from the first supporting element (14) axially in the closing direction of the nozzle needle (8), wherein the first and second supporting elements (14, 16) have respective mutually facing stop surfaces (33, 34), and wherein at least one of the mutually facing stop surfaces (33, 34) has at least one recess (36).

2. The fuel injector as claimed in claim 1, characterized in that the at least one recess (36) is a groove.

3. The fuel injector as claimed in claim 2, characterized in that a cross section of the groove has the shape of a triangle (136).

4. The fuel injector as claimed in claim 2, characterized in that the at least one of the mutually facing stop surfaces (33, 34) has therein a plurality of grooves arranged parallel to one another (536) and/or radially (636) and/or so as to follow a circumference (736).

5. The fuel injector as claimed in claim 2, characterized in that the at least one of the mutually facing stop surfaces (33, 34) has therein a plurality of grooves arranged so as to be curved (836) and/or so as to intersect (936).

6. The fuel injector as claimed in claim 2, characterized in that the at least one of the mutually facing stop surfaces (33, 34) has therein at least two groove groups (1036), group elements of each of the groove groups being arranged parallel to one another and the groove groups being at an angle to one another.

7. The fuel injector as claimed in claim 1, characterized in that the first supporting element (14) and the second supporting element (16) are arranged within a nozzle body (3), which is adjoined by an injector body (4) in a direction of the end of the nozzle needle (8) remote from the combustion chamber.

8. The fuel injector as claimed in claim 7, characterized in that the second supporting element (16) is fixed on the injector body (2) by an end of the supporting element facing the control space.

9. The fuel injector as claimed in claim 1, characterized in that the second supporting element (16) is of multi-part design.

10. The fuel injector as claimed in claim 1, further comprising a return spring (15), which exerts a restoring force on the first supporting element (14) in a direction of the nozzle body seat (10).

11. The fuel injector as claimed in claim 10, characterized in that the return spring (15) is arranged under prestress between the first supporting element (14) and the second supporting element (16).

12. The fuel injector as claimed in claim 1, characterized in that, in order to limit an opening stroke of the nozzle needle (8), the mutually facing stop surfaces (33, 34) of the first supporting element (14) and of the second supporting element (16) come into contact with one another at a maximum opening stroke of the nozzle needle (8), whereby at least one injection opening (5) is opened, wherein the maximum opening stroke of the nozzle needle (8) is defined by a distance (35) between the mutually facing stop surfaces of the first supporting element (14) and of the second supporting element (16) in a closed position of the nozzle needle (8).

13. The fuel injector as claimed in claim 1, characterized in that the nozzle needle (8) has a radially encircling offset (32), wherein the first supporting element (14) rests axially on the radially encircling offset (32) of the nozzle needle (8).

14. The fuel injector as claimed in claim 2, characterized in that a cross section of the groove has the shape of a semicircle (236).

15. The fuel injector as claimed in claim 2, characterized in that a cross section of the groove has the shape of a rectangle.

16. The fuel injector as claimed in claim 2, characterized in that a cross section of the groove has the shape of a square (336).

17. The fuel injector as claimed in claim 2, characterized in that a cross section of the groove has the shape of a trapezoid (436).

* * * * *